US007275477B1

(12) United States Patent
Chen

(10) Patent No.: US 7,275,477 B1
(45) Date of Patent: Oct. 2, 2007

(54) PISTON ASSEMBLY FOR AIR PUMP

(76) Inventor: Chi-Ming Chen, 8F., No. 205, Sec. 3, Pei Hsin rd., Hsintien City, Taipei Hsien (TW)

( * ) Notice: Subject to any disclaimer, the term of this patent is extended or adjusted under 35 U.S.C. 154(b) by 59 days.

(21) Appl. No.: 11/373,190

(22) Filed: Mar. 13, 2006

(51) Int. Cl.
*F04B 39/10* (2006.01)

(52) U.S. Cl. ..... 92/183; 92/181 P; 417/550

(58) Field of Classification Search ..... 92/181 R, 92/183, 181 P; 417/545, 550, 551
See application file for complete search history.

(56) References Cited

U.S. PATENT DOCUMENTS 1,470,548 A * 10/1923 Spohrer ..... 417/415
2,089,630 A * 8/1937 Teeter ..... 417/550
2,985,358 A * 5/1961 Lee et al. ..... 417/490
3,961,868 A * 6/1976 Droege et al. ..... 417/550
7,228,788 B1 * 6/2007 Chen ..... 92/181 P

* cited by examiner

*Primary Examiner*—Marguerite McMahon
(74) *Attorney, Agent, or Firm*—Leong C. Lei

(57) ABSTRACT

A piston assembly of an air pump is provided herein. The piston of the piston assembly has a through exhaust channel along the direction of the piston's back-and-forth movement. The exhaust channel is made up of two aligned exhaust holes, and a space is preserved at where the two exhaust holes interface. A flexible valve piece is provided inside the space, which will flip upward and downward to block the exhaust holes when the piston moves downward and upward, respectively. When the air pump is turned off and the piston stops moving, the exhaust valve piece would be automatically restored to its un-bended state by its own flexibility, allowing the compressed air inside the cylinder to escape through the exhaust holes and around the exhaust valve piece inside the space.

6 Claims, 7 Drawing Sheets

PISTON ASSEMBLY FOR AIR PUMP

BACKGROUND OF THE INVENTION (a) Technical Field of the Invention

The present invention generally relates to air pumps, and more particularly to a piston assembly for quickly releasing the compressed air and inner pressure inside the cylinder of an air pump.

(b) Description of the Prior Art

When an air pump finishes pumping and is turned off, compressed air and thereby a high pressure are still preserved inside the cylinder of the air pump. When the air pump is later started again and the piston is engaged, the piston is resisted by the preserved high pressure and the air pump would suffer an instantaneous load proportional to the cylinder's inner pressure. If the load is large enough, the air pump might not be able to be started, or the motor of the air pump would burn down.

As shown in FIG. 1, a conventional air pump is therefore provided with a pressure releasing device (A1) that is located either on the cylinder (A2) or along the air pipe (A3). Every time before the air pump is started, a button (A4) of the pressure releasing device (A3) is engaged manually to release the compressed air and the inner pressure inside the cylinder (A2), which is quite troublesome.

Some conventional air pumps are configured with a pressure-sensitive releasing device which would be automatically engaged when the inner pressure inside the cylinder has reached a pre-set threshold. In other words, the inner pressure of the cylinder is always maintained within a safety range. This implies that the inner pressure of cylinder is not entirely removed. The remaining inner pressure inside the cylinder would still cause unstable operation of the piston.

Small air pumps such as those for use in households or with motor vehicles usually do not have a pressure releasing device. Instead, a small through exhaust hole is provided on the cylinder so that a portion of the compressed air is always released via the exhaust hole while the remaining compressed air is pumped out through the air pipe. In other words, this kind of small air pumps sacrifices a portion of the compressed air for the resolution of the start-up inner pressure problem. However, this simple solution is not adequate to high-power and high-pressure air pumps. In addition, as some of the compressed air is wasted, the motor of the air pump has to work longer and consumes more electricity. Also, if the air pump is restarted when the compressed air inside the cylinder has not totally escaped through the exhaust hole, the motor would still suffer an instantaneous load.

SUMMARY OF THE INVENTION

The primary purpose of the present invention is to provides a piston assembly for an air pump to obviate the start-up inner pressure problem.

The piston assembly of the present invention has an exhaust channel provided through the piston along the direction of the piston's back-and-forth movement. The exhaust channel is made up of two aligned exhaust holes, and a space is preserved at where the two exhaust holes joint. A flexible valve piece is provided inside the space, which will flip forward and backward to block the exhaust holes (and therefore the exhaust channel) when the piston moves backward and forward, respectively. As such, when the air pump is operated, no compressed air is wasted and a superior pumping efficiency is achieved, in contrast to the conventional approach where some portion of the compressed air is always sacrificed.

When the air pump is turned off and the piston stops moving, the exhaust valve piece would be automatically restored to its un-bended state by its own flexibility, allowing the compressed air inside the cylinder to escape through the exhaust holes, passing around the exhaust valve piece inside the space. Therefore, no additional pressure releasing device and manual operation, are required. In short, the present invention relies on a very simple yet highly reliable mechanical structure buried inside the piston to achieve automatic pressure releasing at almost no additional cost, which is far more superior than conventional approaches.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
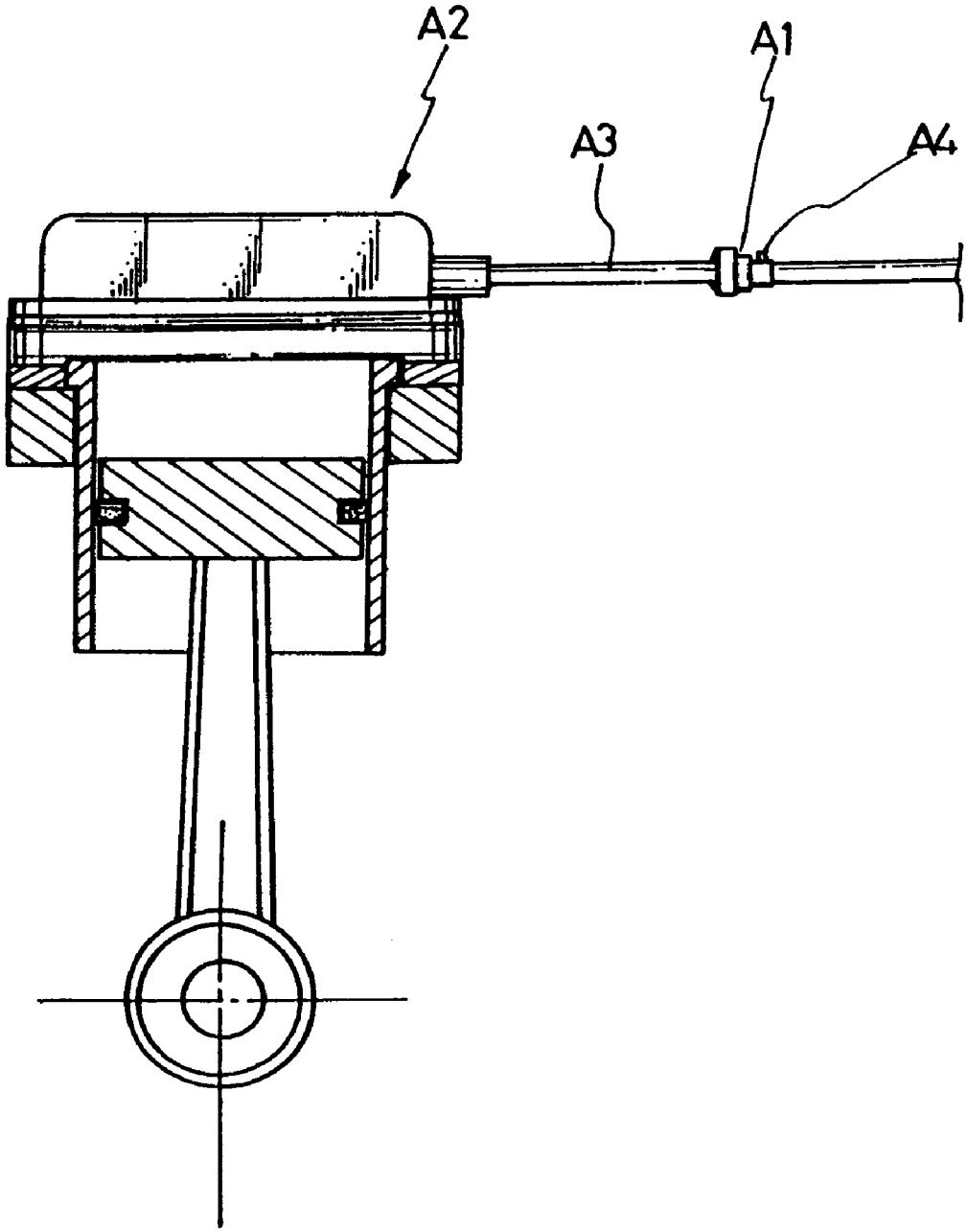
FIG.1 PRIOR ART
FIG. 1 is a sectional view showing a conventional air pump having a pressure releasing device.
Figure 2:
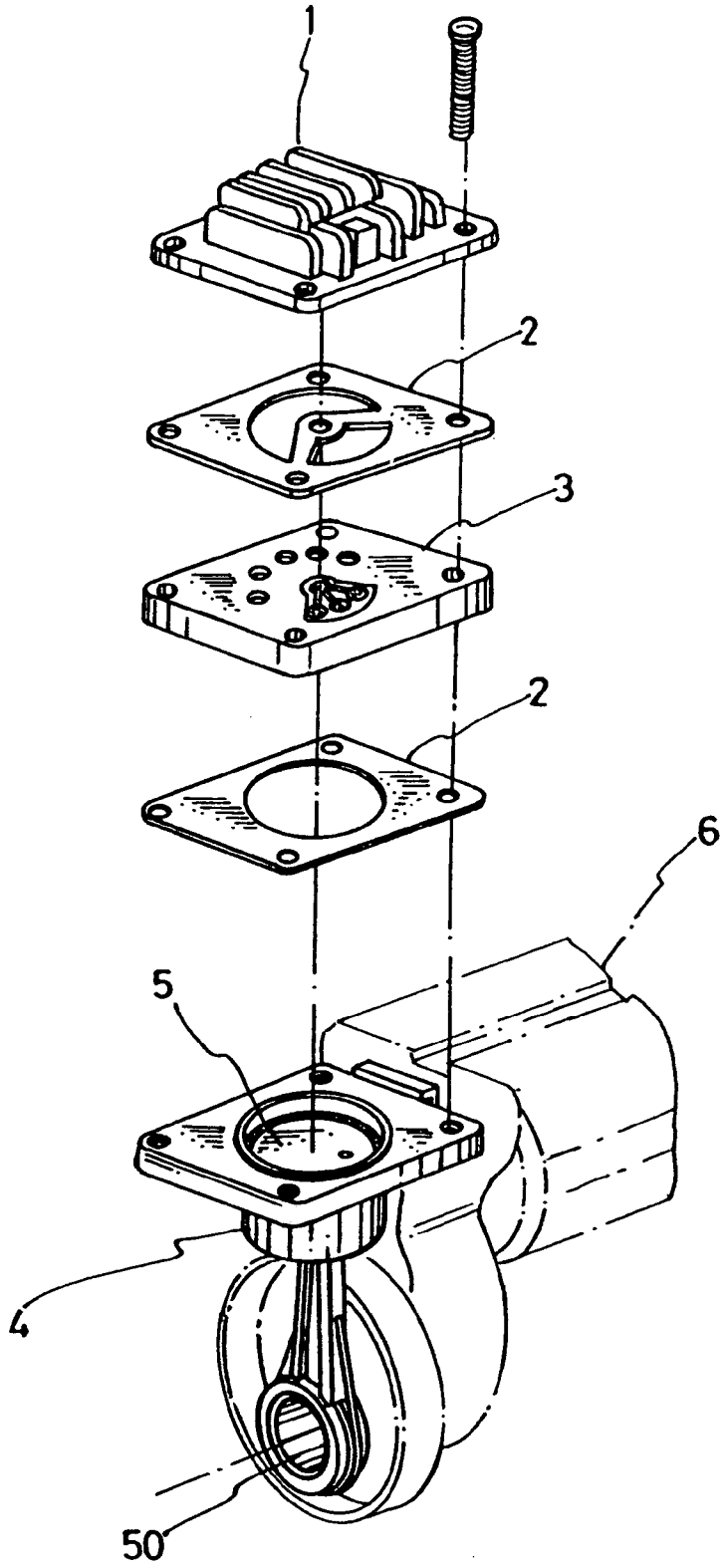
FIG. 2 is a perspective exploded view showing the cylinder assembly of an air pump encompassing an embodiment of the present invention.

As shown in FIG. 2, a cylinder assembly encompassing an embodiment of the present invention, similar to an ordinary cylinder assembly, contains a cylinder cap 1, spacers 2, a seat 3 having intake and output valves through which outside air is drawn and compressed air is pumped respectively, a cylinder 4, a piston assembly 5, and a motor 6, jointly functioning as the main power and pumping mechanism of an air pump. The piston assembly 5 has an axle ring 50 fixedly attached to a crankshaft (not shown) of the motor 6 through which the motor 6 reciprocates the piston assembly 5 back and forth inside the cylinder 4 to draw and pump air.

Figure 3:
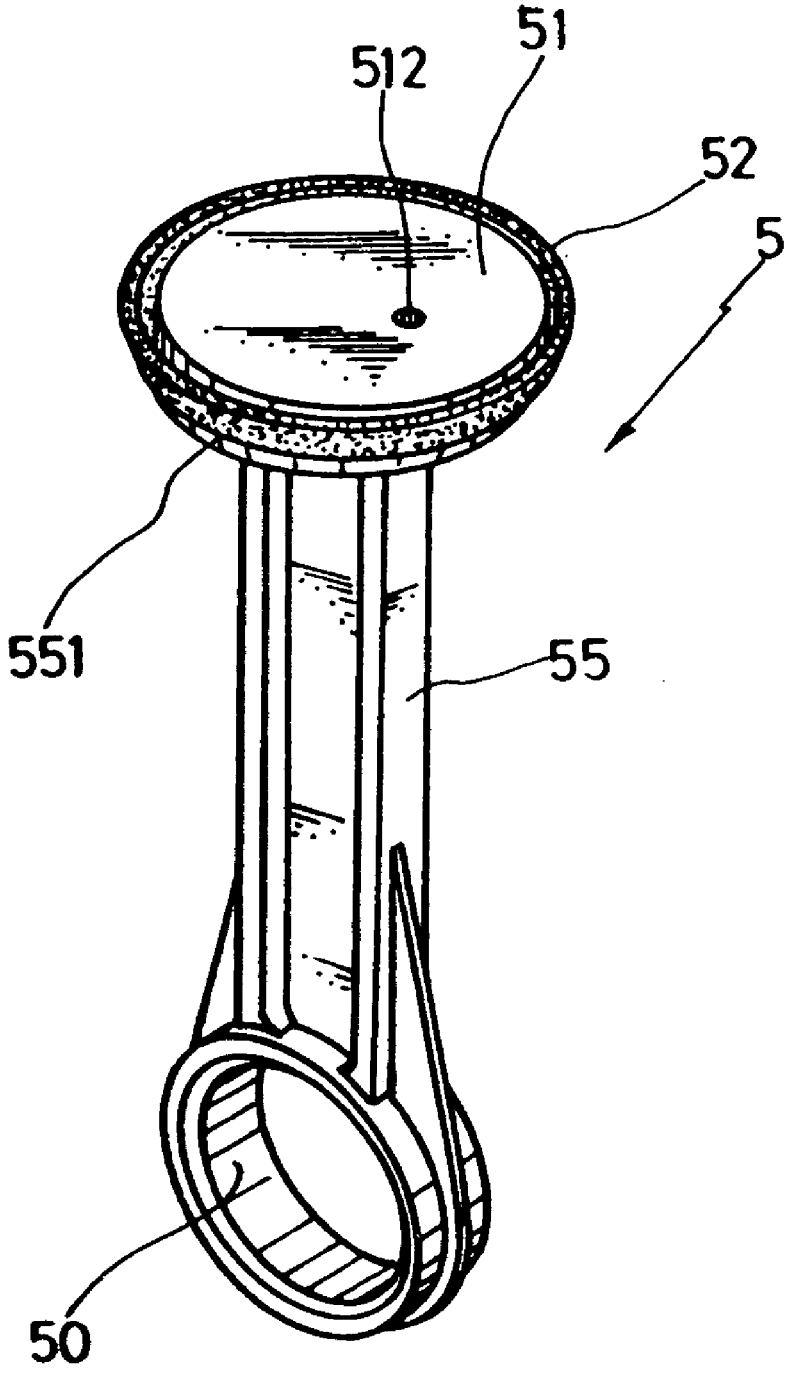
FIG. 3 is a perspective view showing a piston assembly according to an embodiment of the present invention.
Figure 4:
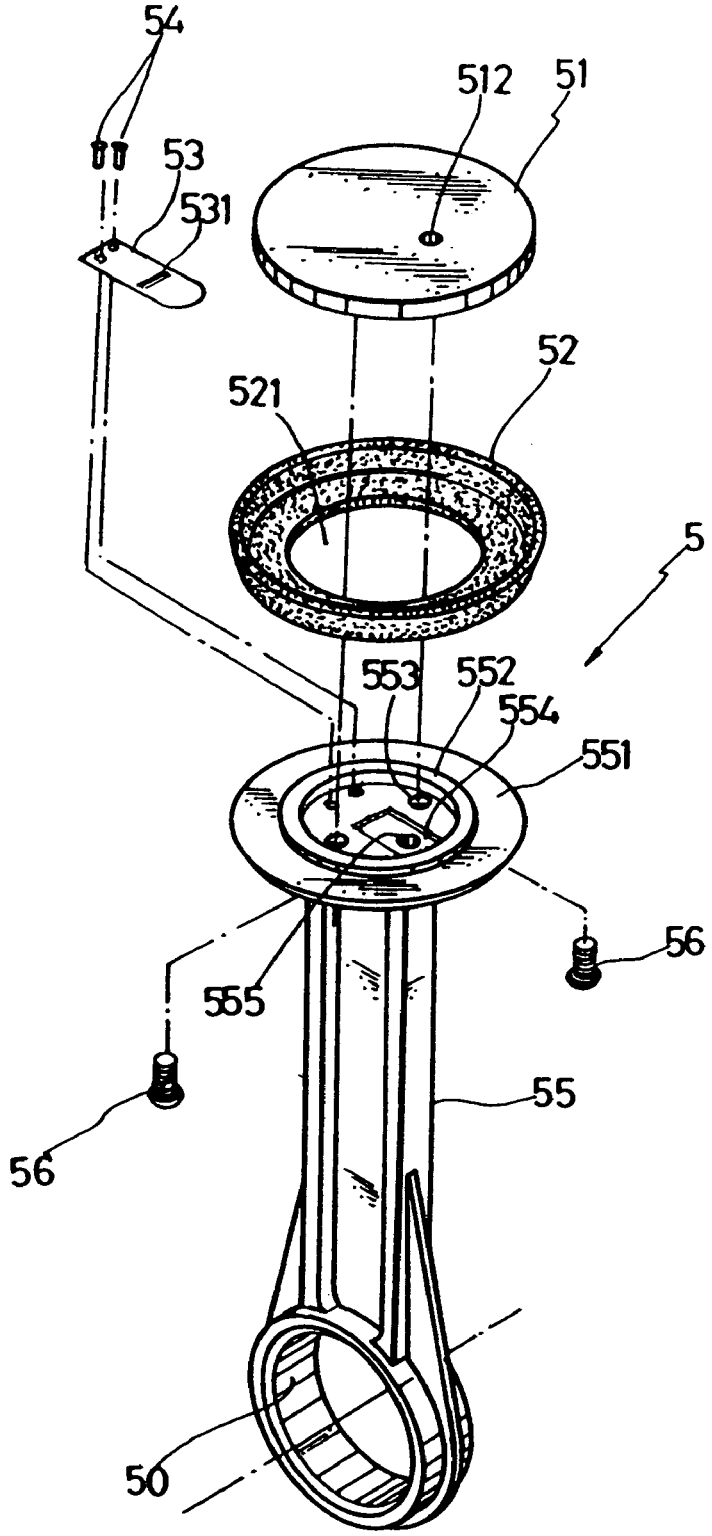
FIG. 4 is a perspective exploded view showing the various components of the piston assembly of FIG. 3.

The subject matter of the present invention lies in the piston assembly 5 whose one embodiment, according to FIGS. 3 and 4, contains a circular plate 51, a ring 52, an exhaust valve piece 53, a number of first fastening elements 54, a connecting rod 55, and a number of second fastening elements 56. The top end of the connecting rod 55 (opposite to the bottom axle ring 50) is molded into a circular supporting seat 551 having a flange ring 552 on the top surface. The ring 52 has a circular opening 521 so that the ring 52 can be stably positioned on the supporting seat 551 with the flange ring 552 fitting inside the circular opening 521. The ring 52 is shaped like a basin allowing the circular plate 51 to be embedded inside. Then, the second fastening elements 56 are used to fixedly joint the plate 51, the ring 52, and the supporting seat 551 together into an integral object via a number of through bolt holes 553 within the area bounded by the flange ring 552.

Figure 5:
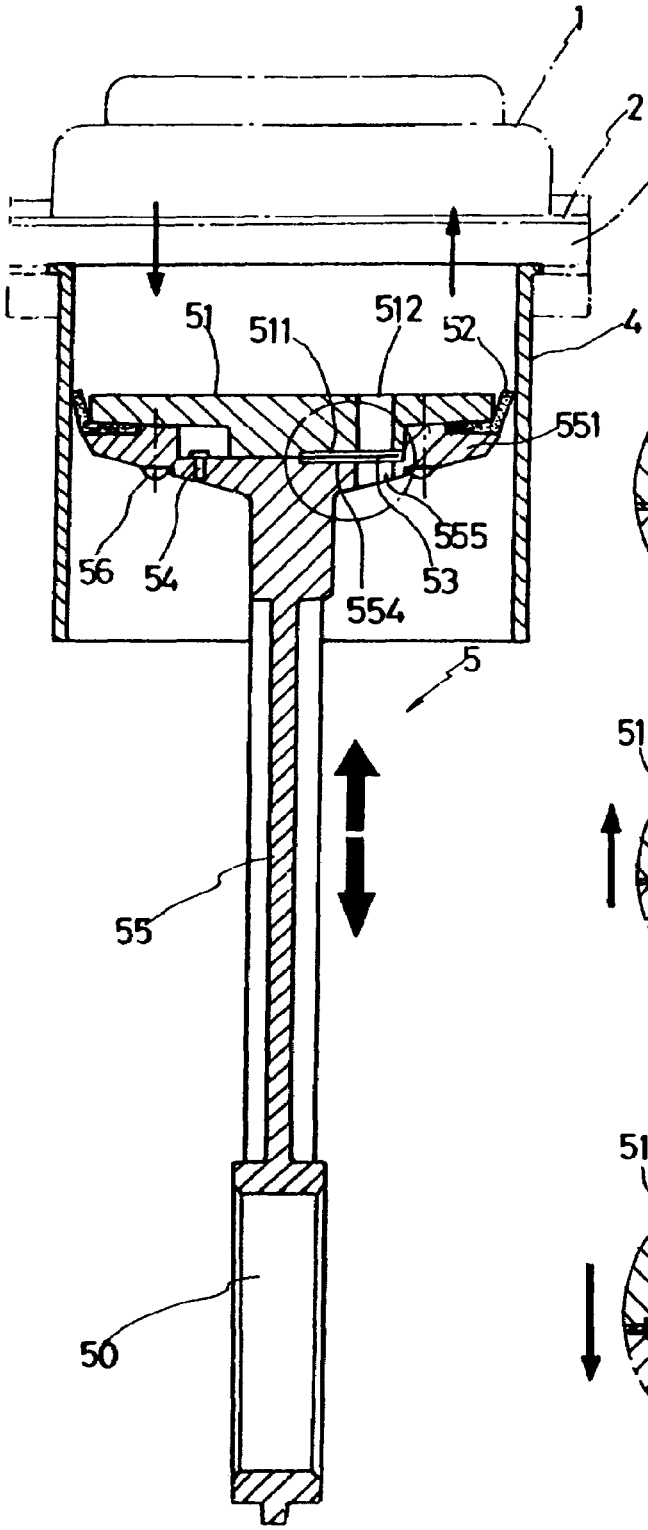
FIG. 5 is a sectional view showing the piston assembly of FIG. 3.

Please also refer to FIG. 5. As shown, within the area bounded by the flange ring 552, in addition to the through bolt holes 553, there is an indentation 554 on the top surface of the supporting seat 551. Correspondingly, on the bottom surface of the circular plate 51, there is an identical but opposite indentation 511. When the circular plate 51 is positioned and jointed to the supporting seat 551, the two indentations 554 and 511 jointly form a space allowing the exhaust valve piece 53 to flip slightly forward and backward by the back-and-forth movement of the piston assembly 5. As shown in FIG. 5, the exhaust valve piece 53 is configured inside the area bounded by the flange ring 52 and is fixedly locked by the first fastening elements 54. When the circular plate 51 is placed on the supporting seat 551, a portion of exhaust valve piece 53 is pressed in between the circular plate 51 and the supporting seat 551, while the other portion is housed inside the space formed by the indentations 554 and 511. Please note that, right within the indentations 554 and 551, the supporting seat 551 and the circular plate 51 are provided with exhaust holes 555 and 512, respectively. As the piston assembly 5 is engaged into fast back-and-forth movement, the exhaust holes 555 and 512 are opened and closed at a high frequency by the flipping of the exhaust valve piece 53. Additionally, as shown in FIG. 4, the exhaust valve piece 53 can be configured with a groove 531 or some holes so as to increase its flexibility.

Further more, the inner shapes of the indentations 554 and 511 can be curved or slant ones so that the space thus formed can have a oval or triangular sectional shape, matching more closely to the flipping movement of the exhaust valve piece 53 inside the space.

Figure 6:
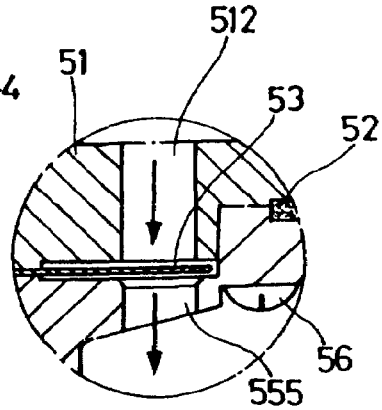
FIG. 6 is an enlarged view showing the compressed air flowing around the exhaust valve piece at its un-bended state when the piston assembly is not moving.
Figure 7:
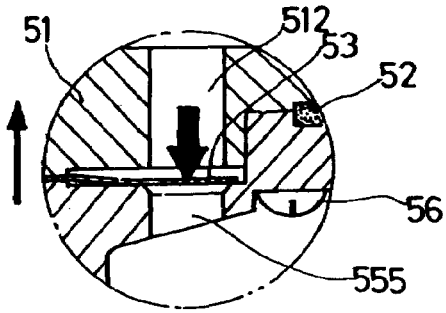
FIG. 7 is an enlarged view showing the exhaust valve piece flipping backward to block air flow when the piston assembly is moving forward.
Figure 8:
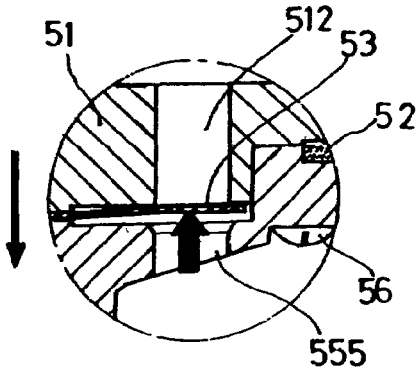
FIG. 8 is an enlarged view showing the exhaust valve piece flipping forward to block air flow when the piston assembly is moving backward.

The flipping movement of the exhaust valve piece 53 is clearly illustrated in FIGS. 6, 7, and 8. As shown in FIG. 6, when the piston assembly 5 is not in back-and-forth movement, the exhaust valve piece 53 is automatically restored to its steady, non-bended state. The exhaust holes 512 and 555 are not blocked by the exhaust valve piece 53, and the compressed air inside the cylinder 4 can therefore quickly escape to the outside of the cylinder 4 through the exhaust holes 512 and 555, passing around the exhaust valve piece 53. The automatic pressure release of an air pump is thereby achieved.

As shown in FIG. 7, when the piston assembly 5 moves forward to compress the air inside the cylinder 4 and force the air into the air pipe (not shown) via the seat 3, the exhaust valve piece 53 is bended backward due to the larger inner pressure of the cylinder 4 and the exhaust valve piece 53's own inertia. As can be clearly seen from FIG. 7, the exhaust hole 555 is therefore blocked, and the compressed air of the cylinder 4 is prevented from leaking through the exhaust holes 512 and 555. As shown in FIG. 8, when the piston assembly moved backward to draw air into the cylinder 4 via the seat 3, the exhaust valve piece 53 is bended forward due to the larger pressure outside the cylinder 4 and the exhaust valve piece 53's own inertia. As can be clearly seen from FIG. 7, the exhaust hole 512 is therefore blocked, and the fresh air drawn into the cylinder 4 is prevented from leaking through the exhaust holes 512 and 555.

Figure 9:
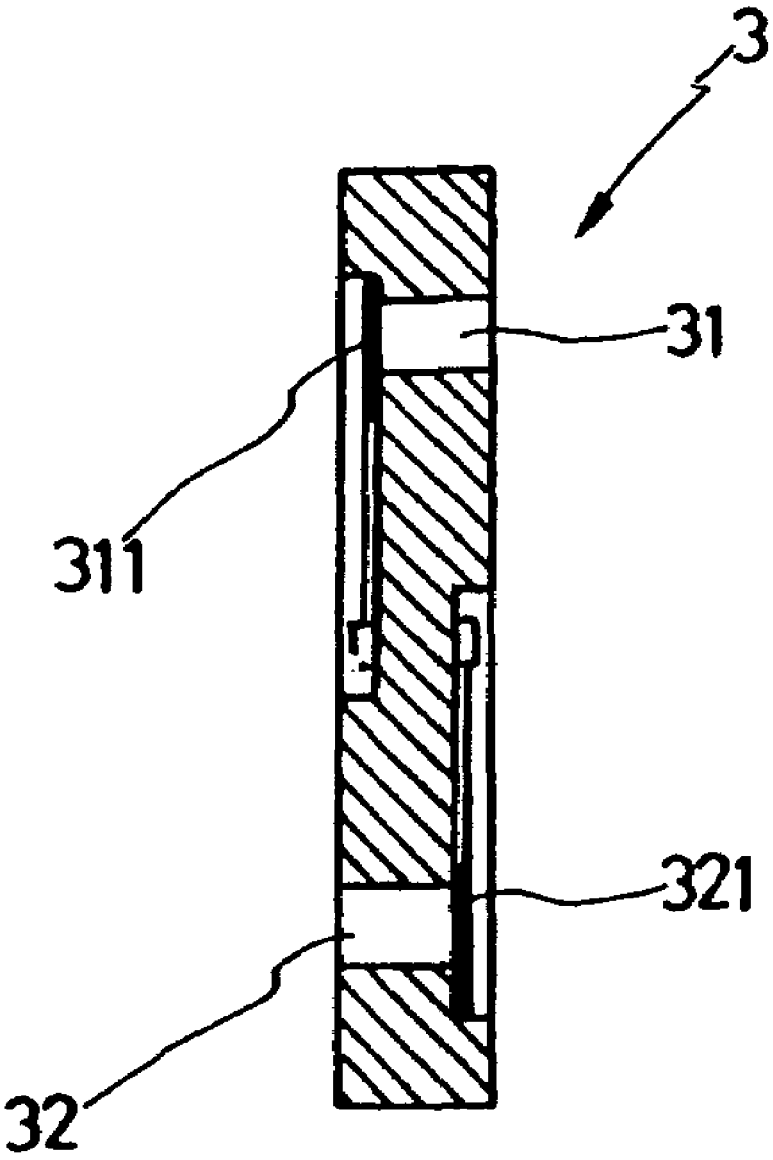
FIG. 9 is a sectional view showing the seat having the intake and output valves of the cylinder assembly of FIG. 2.

As shown in FIG. 9, the seat 3 has separate channels 31 and 32 for air intake and output, respectively. The conduction of the channels 31 and 32 is in turn controlled by the intake valve piece 311 and the output valve piece 321, respectively. When the piston assembly 5 moves backward, the intake valve piece 311 is opened while the output valve piece 321 is closed to drawn air into the cylinder 4. On the other hand, when the piston assembly 5 moves forward, the intake valve piece 311 is closed while the output valve piece 321 is opened so that the compressed air inside the cylinder 4 is forced into the air pipe (not shown).

Figure 10:
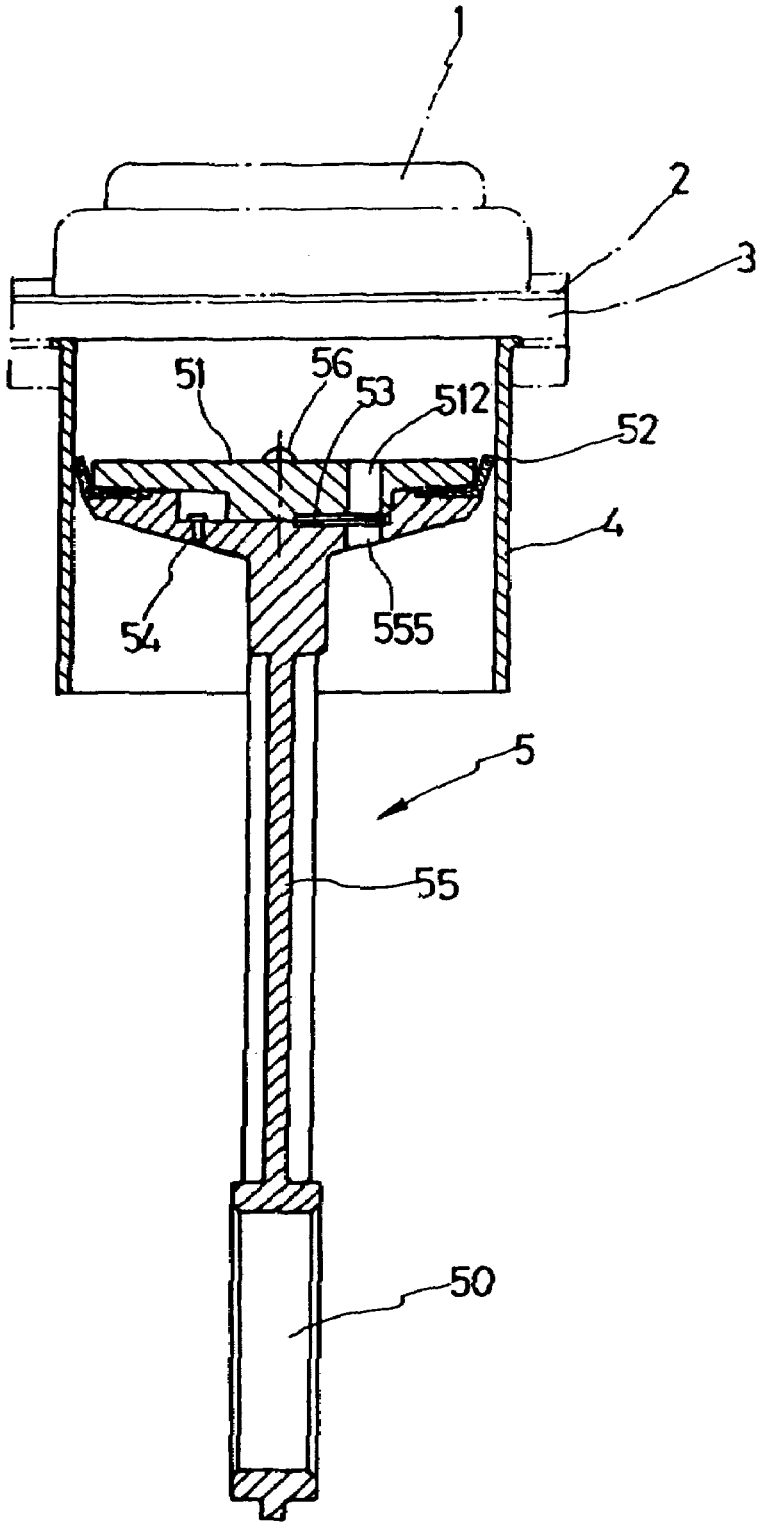
FIG. 10 is a sectional view showing the piston assembly according to another embodiment of the present invention.

FIG. 10 is a sectional view showing the piston assembly 5 according to another embodiment of the present invention. In this embodiment, the second fastening elements 56 are bolted from the plate 51, through the ring 52, and into the supporting seat 551, instead of the other way around as in the previous embodiment (see FIG. 5).

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A piston assembly for an air pump, comprising a plate having a first indentation on a bottom surface of said plate, a through first exhaust hole being provided perpendicular to said plate within said first indentation;

a ring where said plate is laterally embedded, said ring having a central opening;

a connecting rod whose one end is connected to the crankshaft of said air pump and the other end is molded into a supporting seat, said plate and said ring being bolted to said supporting seat by a plurality of fastening elements, said supporting seat having a second indentation on a top surface of said supporting seat corresponding to said first indentation, a through second exhaust hole being provided perpendicular to said supporting seat within said second indentation substantially aligned with said first exhaust hole, said central opening of said ring allowing said first and second indentations jointed with each other, and at least a flexible exhaust valve piece whose portion is pressed between said plate and said supporting seat while the other portion is housed inside said space formed by said first and second indentations, said first and second indentations being configured such that said space allows said exhaust valve piece to flip inside said space;

wherein, when said piston assembly moves backward away from the cylinder of said air pump, said exhaust valve piece flips forward to cover said first exhaust hole; when said piston assembly moves forward into the cylinder of said air pump, said exhaust valve piece flips backward to cover said second exhaust hole; and, when said piston assembly is not moving, said exhaust valve piece returns to its un-bended state by its own flexibility, allowing air to flow through said first and second exhaust holes.

2. The piston assembly according to claim 1, wherein said exhaust valve piece has at least an opening so as to increase its flexibility.

3. The piston assembly according to claim 1, wherein the shape of said first and second indentations is curved or slanted to match the flipping said exhaust valve piece.

4. The piston assembly according to claim 1, wherein said supporting seat has a flange ring on said top surface for fitting inside said central opening of said ring and positioning said ring.

5. The piston assembly according to claim 1, wherein said plurality of fastening elements are bolted from said plate, through said ring, and into said supporting seat.

6. The piston assembly according to claim 1, wherein said plurality of fastening elements are bolted from said supporting seat, through said ring, and into said plate.

* * * * *